US008040204B2

(12) United States Patent
Brown

(10) Patent No.: US 8,040,204 B2
(45) Date of Patent: Oct. 18, 2011

(54) RADIO FREQUENCY COMBINERS/SPLITTERS

(75) Inventor: Forrest James Brown, Carson City, NV (US)

(73) Assignee: DockOn AG, Zurich (CH)

( * ) Notice: Subject to any disclaimer, the term of this patent is extended or adjusted under 35 U.S.C. 154(b) by 0 days.

(21) Appl. No.: 12/991,387

(22) PCT Filed: May 28, 2009

(86) PCT No.: PCT/GB2009/050579

§ 371 (c)(1),
(2), (4) Date: Nov. 5, 2010

(87) PCT Pub. No.: WO2010/001143

PCT Pub. Date: Jan. 7, 2010

(65) Prior Publication Data

US 2011/0102101 A1 May 5, 2011

(30) Foreign Application Priority Data

Jul. 1, 2008 (GB) ..... 0811990.1

(51) Int. Cl.
*H01P 5/12* (2006.01)
*H01P 1/213* (2006.01)

(52) U.S. Cl. ..... 333/125; 333/126; 333/136; 333/34

(58) Field of Classification Search ..... 333/100, 333/124–129, 136, 32–35
See application file for complete search history.

(56) References Cited

U.S. PATENT DOCUMENTS

| | | | | |
|---|---|---|---|---|
| 3,815,055 | A | 6/1974 | Plunk et al. | |
| 4,968,958 | A | 11/1990 | Hoare | |
| 6,037,911 | A | 3/2000 | Brankovic et al. | |
| 6,380,825 | B1 * | 4/2002 | Takenoshita et al. | 333/137 |

FOREIGN PATENT DOCUMENTS

| | | | |
|---|---|---|---|
| EP | 0089083 | A | 9/1983 |
| EP | 0357140 | A | 3/1990 |

OTHER PUBLICATIONS

M Villegas et al, "Analysis and design of microwave T-junction circuits for prescribed response characteristics," Proceedings of 36th Midwest Symposium on Circuits and Systems, vol. 1, Aug. 16, 1993, pp. 604-607, XP002539356, Detroit, MI, USA.

Preetham B Kumar et al, "Optimization of Microwave T-junction Power-Divider Circuits," Proceedings of the Midwest Symposium on Circuits and Systems, Lafayette, Aug. 3-5, 1994, New York, IEEE, US, vol. Symp. 37, Aug. 3, 1994, pp. 1235-1238, XP000531885, ISBN: 978-0-7803-2429-9.

* cited by examiner

*Primary Examiner* — Benny Lee
*Assistant Examiner* — Gerald Stevens
(74) *Attorney, Agent, or Firm* — SilverSky Group, LLC

(57) ABSTRACT

Disclosed is a radio-frequency divider comprising: an input port; and two output ports, separated by a bridge bar, wherein the divider is arranged in microstrip form and the microstrip structure takes the form of a generally tapering section connecting the input port to the bridge bar such that the input port is positioned at the relatively thinner end of the tapering section and the bridge bar is positioned at the relatively wider end of the tapering section. Also disclosed is a corresponding method. The divider is able to operate equally as a combiner.

20 Claims, 2 Drawing Sheets

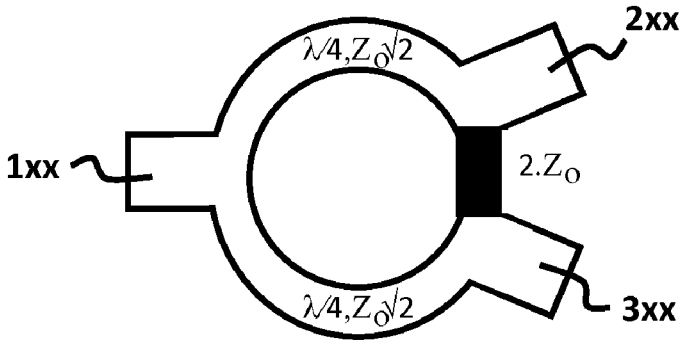
(PRIOR ART) FIG. 1
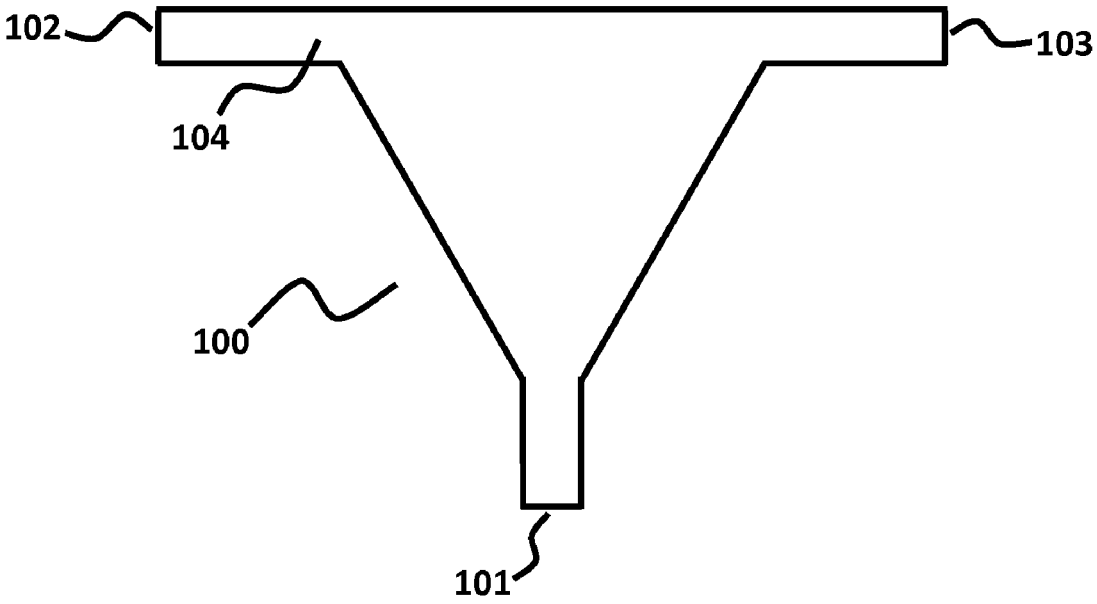
FIG. 2

RADIO FREQUENCY COMBINERS/SPLITTERS

The present invention relates to a multiport splitter (divider) or combiner. It finds particular, but not exclusive, use in allowing a single transceiver to be connected to a plurality of antennas or other devices.

It is often advantageous to be able to drive more than one transmitting antenna, or to receive signal from more than one receiving antenna. However, due to problems in impedance mismatch, it is not a simple matter of connecting more than one antenna to the respective input or output of a transceiver. Having more than one receive antenna, for instance, allows a degree of receive diversity to be employed and can increase the received signal strength.

Throughout the specification which follows, reference will be made to splitting or dividing a signal into two or more components, but the skilled person will appreciate that such description also includes combining two or more signals together, since both the prior art described and embodiments of the invention are intrinsically bi-directional.

Prior art techniques for splitting a signal from a single source to feed e.g. a pair of antennas can take a number of different forms. One particular technique uses the well-known Wilkinson Divider. This is shown in FIG. 1. It has the advantage of being relatively cheap, easy to design and implement and offers a predictable and relatively efficient performance at a given frequency. However, since the Wilkinson Divider relies on quarter-wavelength transformer elements, it is frequency dependent and so cannot offer good performance over anything her than a relatively narrow band. This can render it useless for certain wideband (or dual-band) applications.

The Wilkinson Divider of FIG. 1 has three ports labeled 1, 2 and 3. A signal applied to port 1 will be split and emerge as two identical signals from ports 2 and 3. The signal emerging from port 2 and 3 is attenuated by somewhat more than 3 dB compared to the signal input to port 1. In an ideal twin-output divider, the signal from each output port would be 3 dB down on the input signal. In a real Wilkinson Divider, the signal from each output is a little more than 3 dB down, due to losses in the balancing resistor.

Assuming that impedance of the transmitter applied to port 1 is 50 Ohm ($Z_0$), then to ensure maximum power transfer to a pair of 50 Ohm loads, then the impedance at ports 2 and 3 needs to be the same. To ensure this, the path between ports 1 and 2 (and 1 and 3) needs to be a quarter wavelength at the frequency of operation. This sets the characteristic impedance of each branch to be $Z_O\Lambda/2$=707 Ohm in this example. The Wilkinson divider requires the use of a balancing resistor between the two branches. This is set to a value of $2Z_0$=100 Ohm. The balance resistor increases the insertion loss of the device, but this is unavoidable in this device.

According to the present invention there is provided an apparatus as set forth in the following disclosure. Other features of the invention will be apparent from the description which follows.

For a better understanding of the invention, and to show how embodiments of the same may be carried into effect, reference will now be made, by way of example, to the accompanying diagrammatic drawings in which:

FIG. 1 shows a prior art Wilkinson Divider in microstrip form;

FIG. 2 shows a first embodiment of the present invention;

Figure 3:
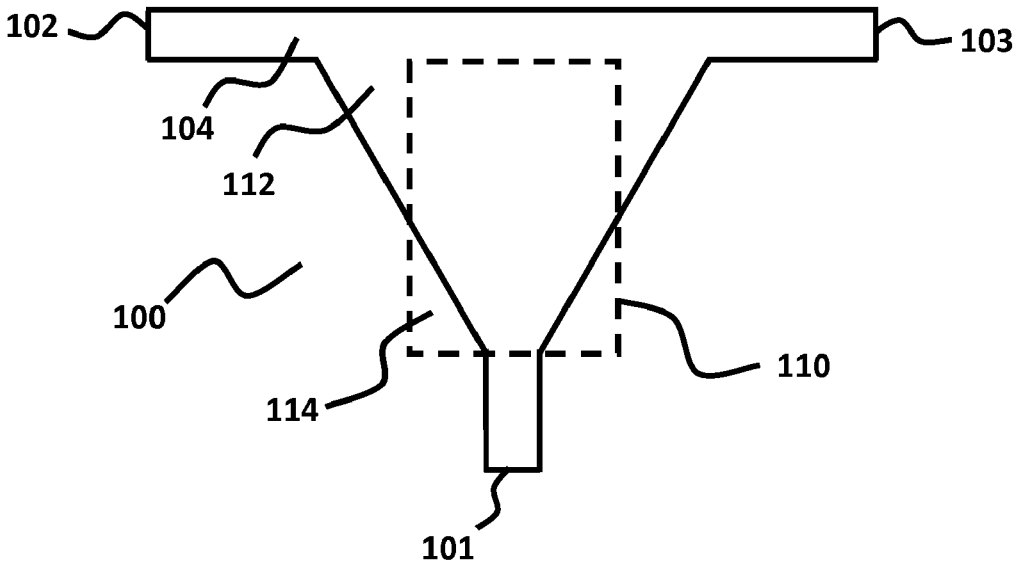
FIG. 3 shows the first embodiment of FIG. 2 with some added constructional detail.

Embodiments of the present invention realize the aim of splitting a signal or combining a plurality of signals in a simple manner, without the need for any discrete components, using only microstrip techniques.

FIG. 2 shows an embodiment of the invention constructed using microstrip techniques i.e. the traces are formed by selective removal of metal from a circuit board. The removal can be effected by any suitable means such as etching or laser removal.

The divider 100 of FIG. 2 comprises a first port 101 and two output ports 102, 103. Note that each input port may also be an output port and vice-versa as the divider may also function as a combiner i.e. it is inherently bi-directional.

The input port 101 is located adjacent the vertex of a generally triangular section which tapers outwards to join a generally rectangular section, at whose respective ends are located ports 102, 103. The port 101 is actually at the end of a short, generally rectangular section. The width of this section is determined by the characteristic impedance of the device connected thereto. For instance, if port 101 is to be connected to a device having an impedance of 50 Ohm, then the width of the rectangular second can be calculated accordingly using known techniques and based on the characteristics of the circuit board.

The triangular section joining port 101 to ports 102, 103 serves to provide a generally wideband match between the characteristic impedance of port 101 and ports 102, 103.

In a typical installation, the characteristic impedance of each port will be 50 Ohms. Therefore, the tapering triangular section must match the 50 Ohm impedance of port 101 to an impedance of 25 Ohms formed by ports 102 and 103 being arranged, effectively, in parallel.

The slowly tapering outline of the triangular section serves to provide a slow transition from 50 Ohms at port 101 to 25 Ohms. It also provides isolation of >20 dB between ports 102 and 103.

Ports 102 and 103 are separated by a generally rectangular element 104, herein termed a bridge bar. The dimensions of the bridge bar are selected such that its width (smallest dimension in the plane) is determined by the characteristic impedance of the devices connected to ports 102 and 103. Its length (longest dimension in the plane) is set so that ports 102 and 103 are a quarter wavelength apart at the centre frequency of operation of the divider.

Also, the physical separation between port 101 and 102 and between port 101 and 103 is set to be a quarter of a wavelength at the centre frequency of operation. This structure provides the required isolation between ports.

This can be explained thus: a signal appearing at port 101 which travels to port 102 and is reflected hack has had a 90° phase shift on each leg of its journey, meaning that, by the time it arrives back at port 101, it is out of phase and so cancels itself out. This is true for all the ports, ensuring that there is good isolation between them all. The tapered section ensures that this isolation is achieved across a wider bandwidth than would be the case if it were absent. In practice, isolation of greater than 30 dB has been measured.

The embodiment of FIG. 2 offers a bandwidth of an octave and a half, and requires no external components to achieve this, making it very simple to implement and cost-effective.

FIG. 3 shows the embodiment of FIG. 2 with some added constructional details to explain how certain of the dimensions of the divider are arrived at. The dotted rectangle 110 has a height equivalent to the tapering section of the triangular portion and a width equivalent to the mean width of the tapering section. If the microstrip construction were adapted such that the tapering section were replaced with the dotted rectangular section, the rectangular section would provide a narrow band match between port 101 and ports 102, 103.

It can be seen that the area of the dotted rectangular section corresponds to the area of the triangular section. Conceptually, it is possible to imagine that the triangular pardon 114 is removed from the rectangle 110 and positioned to form triangular portion 112. The same happens on the other side of the triangular portion.

The width of the rectangular portion 110 is determined by the line impedance required to transform the impedance of port 101 into the ports 102 and 103 in parallel. The formula:

$$Z_{width}=\sqrt{(Z_{101}\times Z_{102}/Z_{103})}$$

can be used to determine the width of the rectangular portion by taking the square root of the product of the impedance of port 101 and the parallel effect of the impedances at ports 102 and 103.

if all the ports are 50 Ohms, then ports 102 and 103 in parallel will present an impedance of 25 Ohm. This then gives a value for $Z_{width}$ of 35.36 Ohm. From this value of impedance, the width can be directly determined using known techniques.

The tapering shape can then be set, using this value as a mid-point of the section, as described above. The tapering section acts in practice like a series of discrete L-C circuits, which act to provide a wideband match, If the tapered section is created using linear gradients i.e. the width of the tapered section changes uniformly, then the matching performance is linear. If, however, the tapered section is made non-linear e.g. it has convex, concave or other curved portions, then the matching performance can be made to alter in a non-linear fashion too. For instance, if a device were connected to one of the ports and its characteristic impedance alters with frequency, then the tapered section can be designed to accommodate this and ensure that a good match is achieved at all frequencies of operation.

It can be seen then that an embodiment of the invention can provide a simple, low-cost alternative to the Wilkinson Divider, requiring no external components and offering better power performance (lower insertion loss) over a wider bandwidth. Also, since an embodiment of the present invention requires no matching resistor, there is no corresponding insertion loss, resulting in enhanced power performance.

Figure 4:
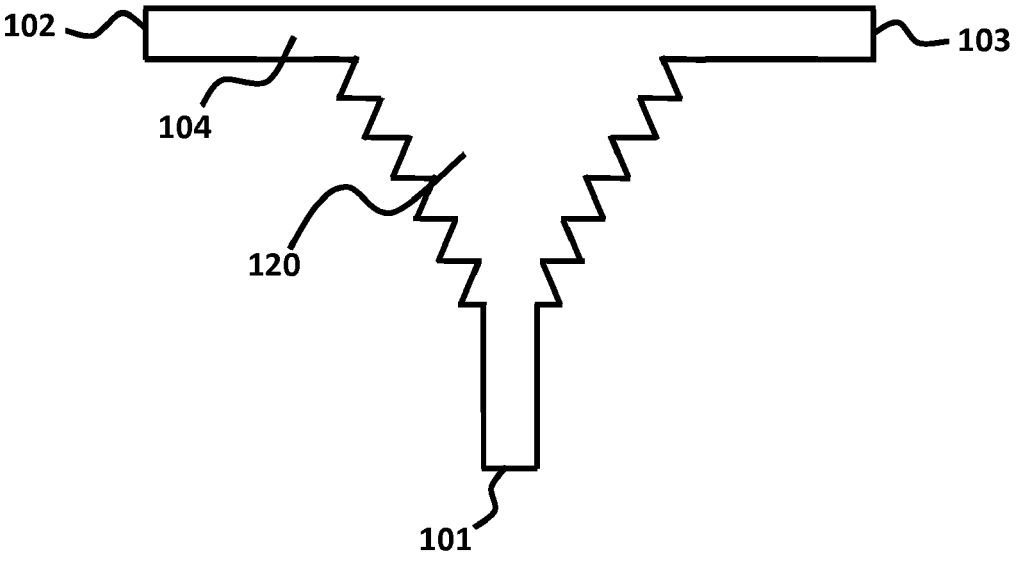
FIG. 4 shows a second embodiment of the present invention.

An alternative embodiment of the invention provides a divider operable over an even greater bandwidth, or it can be implemented as a dual-band device. This is shown in FIG. 4. FIG. 4 differs from the device of FIG. 2 in that the tapered section 120 no longer has linear edges. The embodiment shown here follows a generally linear trend, as before, but the outer edges are jagged and comprise a generally saw-tooth or zig-zag structure.

The effect of this is to cause the divider to operate over two discrete frequency hands. The first is determined as before by the characteristic shape of the tapered structure assuming that the jagged edges are not there and the outer edges are smooth, as in FIG. 2. The second band of operation is altered by the presence of the jagged edges, which in microstrip circuits have different reactive qualities. By careful design of the physical layout, using known techniques, the skilled person can design a divider operable over two discrete frequency bands.

Of course, it is possible to design the two frequency bands so that they overlap, offering a device operable over one wider band than is possible using the design of FIG. 2 alone.

Embodiments of the invention find particular use in Radio Frequency (RF) devices operable over at least two bands. It is quite common to offer cellular telephones which operate on at least two bands and by use of an embodiment of the present invention, two different antennas can be provided—one for each band—and they can be connected via a divider to a single radio transceiver.

The frequency of operation of devices according to embodiments of the invention will generally be in the GHz range, and used with wireless telephony and wireless data access devices.

Other uses in a range of fields will be apparent to the skilled person.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A radio-frequency divider comprising:

an input port;

two output ports, separated by a generally rectangular bridge bar having a width selected to match the impedance of one or more devices to be connected to the two output ports and a length selected to provide a separation between the two output ports of substantially ¼ wavelength at a center point of an operational frequency of the devices; and a generally tapering microstrip section having a relatively thinner end and a relatively wider end, the relatively thinner end connected to the input port and the relatively wider end connected along a part of the length of the bridge bar, the generally tapering microstrip section providing a separation between the input port and each of the two output ports of substantially ¼ wavelength at the center point.

2. The divider of claim 1, wherein the operational frequency is substantially an octave and a half and wherein the generally tapering microstrip section has two substantially linear shaped external edges.

3. The divider of claim 1, wherein the operational frequency includes a first frequency and a second frequency and wherein the generally tapering microstrip section has two substantially saw-tooth shaped external edges.

4. The divider of claim 3, wherein the first frequency overlaps with the second frequency to create the operational frequency.

5. The divider of claim 1, wherein the devices have a characteristic impedance that alters with frequency and wherein the generally tapering microstrip section has two substantially non-linear shaped external edges that ensure a matching impedance to the devices at all frequencies of operation.

6. The divider of claim 1, wherein the generally tapering microstrip section acts as a series of L-C circuits providing a wideband match.

7. The divider of claim 1, wherein the two output ports each have a characteristic impedance of half of a characteristic impedance of the input port.

8. The divider of claim 1, wherein the shape of the tapering section is determined based on an impedance matched mid-point of an area represented by the tapering section.

9. The divider of claim 1, wherein the tapering section has an area substantially equivalent to a rectangle having a length the same as a length of the tapering section and a width determined by the line impedance required to transform an impedance of the input port into impedances of the two output ports in parallel.

10. The divider of claim 1, wherein the tapering section has an area substantially equivalent to a rectangle having a length the same as a length of the tapering section and a width determined from a width impedance calculated as a square root of a product of an impedance of the input port and a first output impedance of a first of the two output ports divided by a second output impedance of the second of the two output ports.

11. A radio-frequency combiner comprising:

an output port;

two input ports, separated by a generally rectangular bridge bar having a width selected to match the impedance of one or more devices to be connected to the two input ports and a length selected to provide a separation between the two input ports of substantially ¼ wavelength at a center point of an operational frequency of the devices; and a generally tapering microstrip section having a relatively thinner end and a relatively wider end, the relatively thinner end connected to the output port and the relatively wider end connected along a part of the length of the bridge bar, the generally tapering microstrip section providing a separation between the output port and each of the two input ports of substantially ¼ wavelength at the center point.

12. The combiner of claim 11, wherein the operational frequency is substantially an octave and a half and wherein the generally tapering microstrip section has two substantially linear shaped external edges.

13. The combiner of claim 11, wherein the operational frequency includes a first frequency and a second frequency and wherein the generally tapering microstrip section has two substantially saw-tooth shaped external edges.

14. The combiner of claim 13, wherein the first frequency overlaps with the second frequency to create the operational frequency.

15. The combiner of claim 11, wherein the devices have a characteristic impedance that alters with frequency and wherein the generally tapering microstrip section has two substantially non-linear shaped external edges that ensure a matching impedance to the devices at all frequencies of operation.

16. The combiner of claim 11, wherein the generally tapering microstrip section acts as a series of L-C circuits providing a wideband match.

17. The combiner of claim 11, wherein the two input ports each have a characteristic impedance of half of a characteristic impedance of the output port.

18. The combiner of claim 11, wherein the shape of the tapering section is determined based on an impedance matched mid-point of an area represented by the tapering section.

19. The combiner of claim 11, wherein the tapering section has an area substantially equivalent to a rectangle having a length the same as a length of the tapering section and a width determined by the line impedance required to transform an impedance of the output port into impedances of the two input ports in parallel.

20. The combiner of claim 11, wherein the tapering section has an area substantially equivalent to a rectangle having a length the same as a length of the tapering section and a width determined from a width impedance calculated as a square root of a product of an impedance of the output port and a first input impedance of a first of the two input ports divided by a second input impedance of the second of the two input ports.

* * * * *

UNITED STATES PATENT AND TRADEMARK OFFICE

CERTIFICATE OF CORRECTION

PATENT NO. : 8,040,204 B2
APPLICATION NO. : 12/991387
DATED : October 18, 2011
INVENTOR(S) : Forrest James Brown It is certified that error appears in the above-identified patent and that said Letters Patent is hereby corrected as shown below:

In column 1, line 6, after “receive” insert -- a -- before “signal”.

In column 2, line 52, after “reflected” delete “hack” and insert -- back -- before “has”.

In column 3, line 7, after “triangular” delete “pardon” and insert -- portion -- before “114”.

In column 3, line 21, capitalize -- If -- at beginning of paragraph.

In column 3, line 56, after “frequency” delete “hands” and insert -- bands -- before “The”.

Signed and Sealed this
Twentieth Day of December, 2011

David J. Kappos

David J. Kappos
*Director of the United States Patent and Trademark Office*